US006686789B2

(12) United States Patent
Lopata et al.

(10) Patent No.: US 6,686,789 B2
(45) Date of Patent: Feb. 3, 2004

(54) DYNAMIC LOW POWER REFERENCE CIRCUIT

(75) Inventors: Douglas D. Lopata, Boyertown, PA (US); Bernard Lee Morris, Emmaus, PA (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 10/109,245

(22) Filed: Mar. 28, 2002

(65) Prior Publication Data

US 2003/0184363 A1 Oct. 2, 2003

(51) Int. Cl.[7] ..... G05F 3/02
(52) U.S. Cl. ..... 327/334; 327/546
(58) Field of Search ..... 327/535, 540, 327/541, 545, 546, 530, 334

(56) References Cited

U.S. PATENT DOCUMENTS 5,506,495 A * 4/1996 Uchida ..... 323/315
5,812,021 A * 9/1998 Ikeda ..... 327/541
5,872,479 A * 2/1999 Shin ..... 327/537
5,892,394 A * 4/1999 Wu ..... 327/546
6,002,295 A * 12/1999 Gens et al. ..... 327/546
6,011,428 A * 1/2000 Tsukude et al. ..... 327/541
6,011,429 A * 1/2000 Oda ..... 327/546
6,166,530 A * 12/2000 D'Angelo ..... 323/316
6,191,994 B1 * 2/2001 Ooishi ..... 365/226
6,255,895 B1 * 7/2001 Kim et al. ..... 327/530
6,313,694 B1 * 11/2001 Sohn ..... 327/541
6,404,274 B1 * 6/2002 Hosono et al. ..... 327/538

* cited by examiner

*Primary Examiner*—Terry D. Cunningham
(74) *Attorney, Agent, or Firm*—Ryan, Mason & Lewis, LLP

(57) ABSTRACT

A dynamic low power reference circuit includes a reference source for generating a reference voltage and/or a reference current. The reference circuit further includes an activity detector configured to measure an activity level of at least a portion of another circuit coupled to the reference circuit and to generate a control signal representative of the activity level. A controller coupled to the reference source is configured to dynamically change an output impedance of the reference circuit in response to the control signal. The techniques of the present invention thus provide a reference circuit that is capable of dynamically changing an output impedance associated therewith, such that when activity on one or more nodes in the other circuit is detected within a time period, the output impedance of the reference circuit is at a first value which is sufficiently low so as to reduce the likelihood of noise being coupled onto the output of the reference circuit. Alternatively, when essentially no activity on the one or more nodes is detected within the time period, the output impedance of the reference circuit is at a second value which is greater than the first value, thereby reducing power consumption in the reference circuit.

12 Claims, 3 Drawing Sheets

DYNAMIC LOW POWER REFERENCE CIRCUIT

FIELD OF THE INVENTION

The present invention relates generally to reference circuits, and more particularly relates to a dynamic low power reference circuit.

BACKGROUND OF THE INVENTION

Many circuits employed in a variety of system applications require a reference source (e.g., reference voltage or reference current), in addition to traditional power supply voltages (e.g., VDD and VSS). With respect to a particular circuit or system, the reference source may be generated either internally or externally. In either case, the reference source consumes a certain amount of quiescent or direct current (DC) power.

It is advantageous, especially in portable devices and other low power systems, to minimize the amount of power consumed by the reference source. Quite often, in order to conserve power, a single reference source is utilized in conjunction with a global reference conductor (e.g., bias line) for supplying a reference voltage or reference current to multiple circuits which may be distributed across an integrated circuit (IC) device. For example, the global reference conductor is typically routed throughout the IC to all sub-circuits which utilize the reference voltage or current. In this manner, the need for individual local reference sources within each sub-circuit may be eliminated, thus reducing overall DC power consumption in the IC. However, the routing of the reference conductor throughout the IC can be difficult, particularly in densely fabricated ICs where interconnect space is already scarce. Furthermore, capacitive coupling associated with such a reference conductor may induce noise onto the conductor, thus corrupting the reference voltage or current. The noise may be generated, for example, by the switching of digital circuits, crosstalk, etc. as may be present in the IC.

To minimize the likelihood of noise coupling onto the reference conductor, a low-impedance reference source can be used, thus maintaining a sufficiently constant voltage or current even in the presence of noise. However, a lower output impedance of the reference source is achieved at the expense of an undesirable increase in DC power consumption in the reference source.

Accordingly, it would be desirable to provide a reference circuit having a low output impedance for reducing the coupling of noise onto the reference output, and which consumes a minimal amount of overall DC power.

SUMMARY OF THE INVENTION

The present invention provides a reference circuit that is capable of dynamically changing an output impedance associated therewith, such that when activity is detected on a given node, for example, in another circuit coupled to the reference circuit, the output impedance of the reference circuit is at a first value which is sufficiently low so as to reduce the likelihood of noise being undesirably coupled onto the output of the reference circuit. Alternatively, when essentially no activity is detected on the node within a predetermined time period, the output impedance of the reference circuit is at a second value which is sufficiently greater than the first value so as to reduce power consumption in the reference circuit.

In accordance with one aspect of the invention, a dynamic low power reference circuit includes a reference source for generating a reference voltage and/or a reference current. The reference circuit further includes an activity detector configured to measure an activity level of at least a portion of another circuit coupled to the reference circuit (e.g., in an IC which includes the reference circuit), and to generate a control signal representative of the activity level. A controller coupled to the reference source is configured to dynamically change an output impedance of the reference circuit in response to the control signal, such that the output impedance is substantially reduced when activity is detected.

These and other features and advantages of the present invention will become apparent from the following detailed description of illustrative embodiments thereof, which is to be read in connection with the accompanying drawings.

DESCRIPTION OF THE PREFERRED EMBODIMENTS

The present invention will be described herein in the context of an illustrative reference circuit. The reference circuit may be used, for example, in conjunction with other analog and/or digital circuitry in an integrated circuit (IC) device. It should be appreciated, however, that the present invention is not limited to this or any particular reference circuit and/or application. Rather, the invention is more generally applicable to providing a reference circuit that is configured to have an output impedance which dynamically changes in response to a detected activity level of one or more circuits using or otherwise associated with the reference circuit. Moreover, although implementations of the present invention are described herein with specific reference to metal-oxide-semiconductor (MOS) transistor devices, it is to be appreciated that the invention is not limited to such transistors, and that other suitable transistors, such as, for example, bipolar junction transistors (BJTs), may be similarly employed, as will be understood by those skilled in the art.

Figure 1:
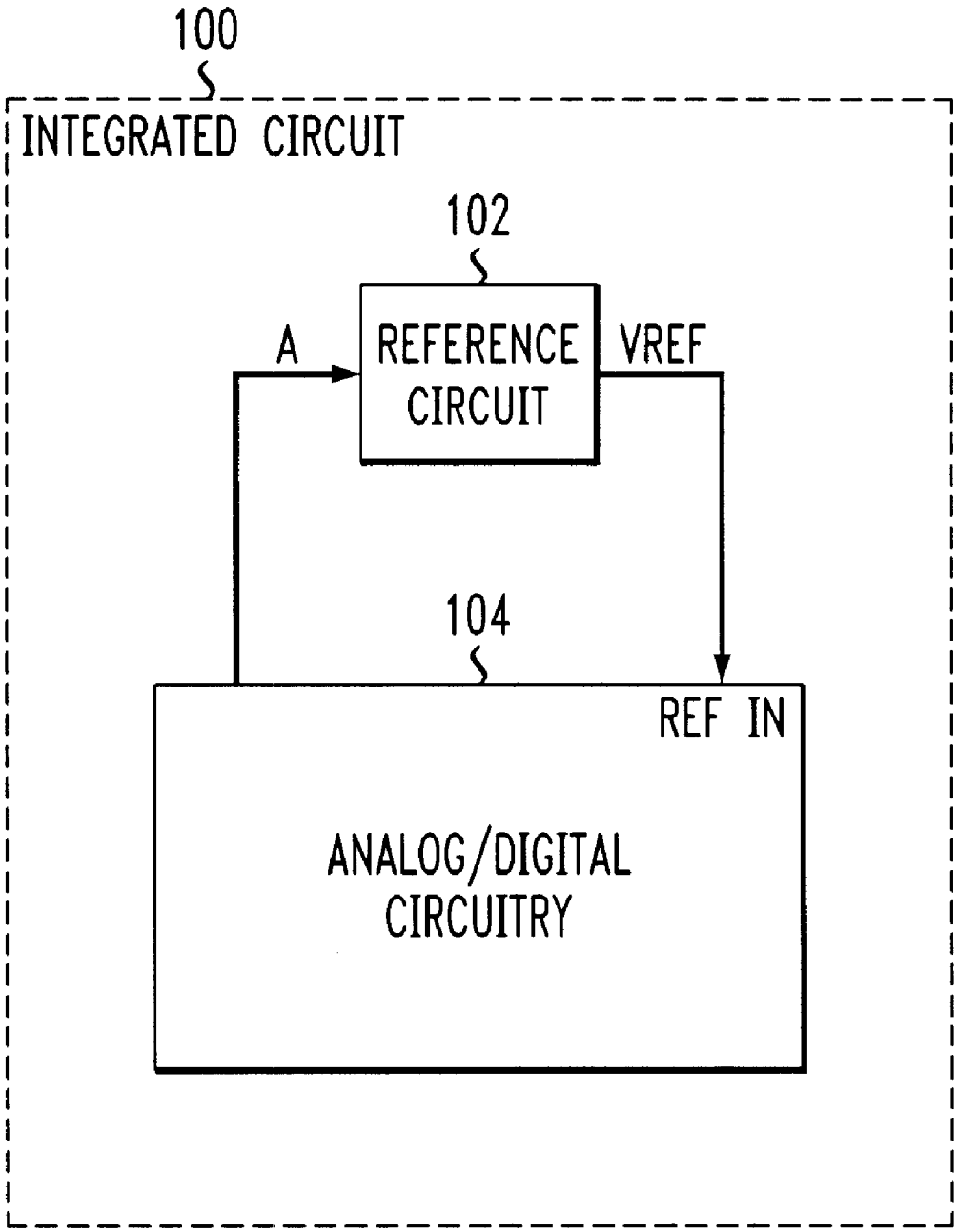
FIG. 1 is a block diagram depicting an integrated circuit including analog/digital circuitry and a reference circuit, formed in accordance with the present invention.

FIG. 1 illustrates a block diagram of an IC device 100 which may include a reference circuit 102 and other analog/digital circuitry 104. It is to be appreciated that the analog/digital circuitry 104 may comprise analog circuits, digital circuits, or a combination of both analog and digital circuits. Reference circuit 102 preferably generates a substantially constant reference output, which may be, for example, a reference voltage VREF. The present invention, however, contemplates that the reference output may be a reference current as well. The analog/digital circuitry 104 preferably utilizes the reference output VREF generated by the reference circuit 102, which is presented to an input REF IN of the analog/digital circuitry 104.

The reference circuit 102 includes an input for receiving an activity level signal A. The activity level signal, which may be an analog or a digital signal, is preferably indicative of a measured activity level of a particular node or nodes in the analog/digital circuitry 104. In the case of a digital signal, for example, the activity level signal maybe a logic high (e.g., VDD) when either a high-to-low or a low-to-high transition is detected at the particular node. Various techniques for measuring the activity level are contemplated by the present invention, including, but not limited to, detecting a change in the voltage level or current level at a given node(s) within a predetermined time interval.

Figure 2:
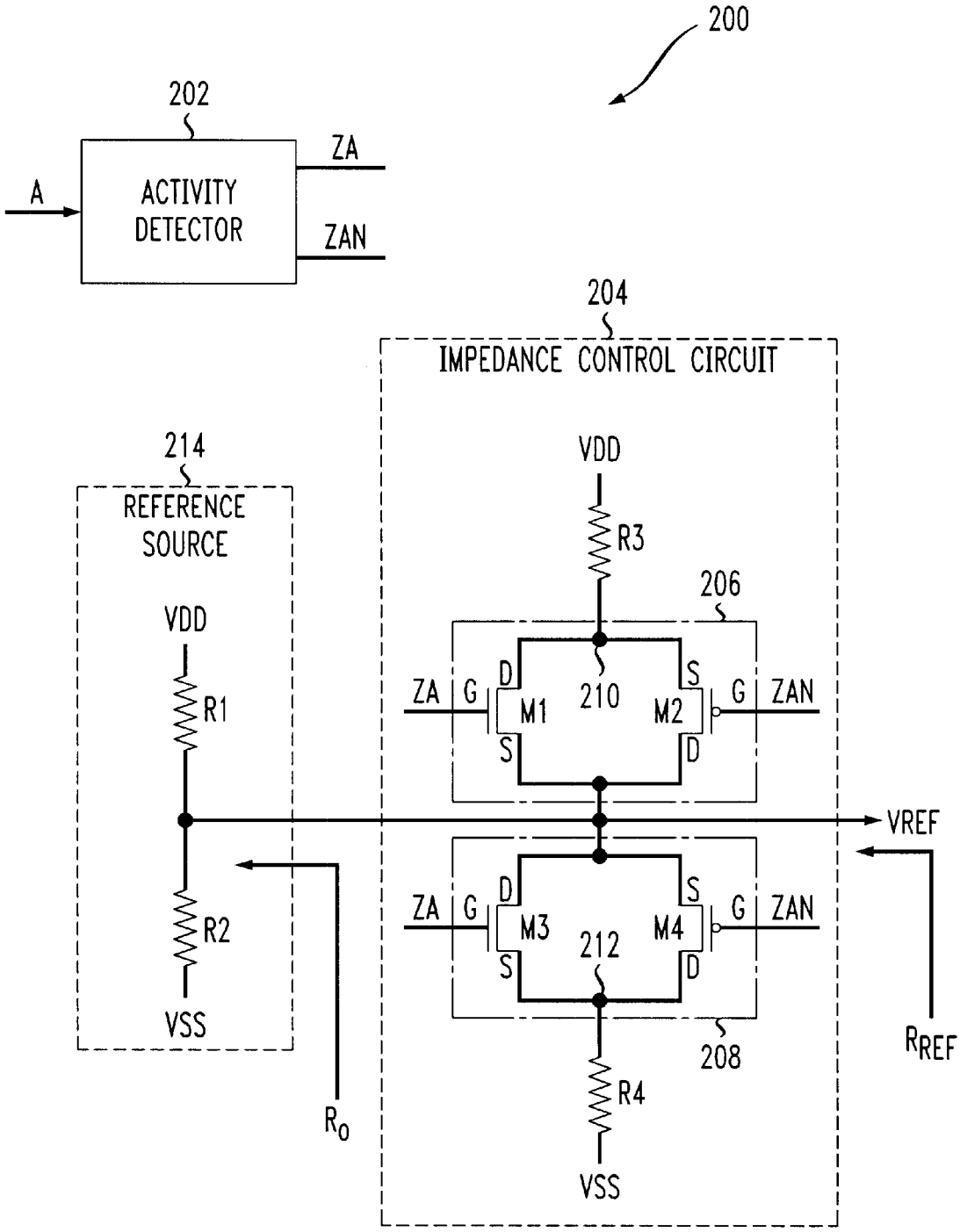
FIG. 2 is a schematic diagram illustrating an exemplary reference circuit, formed in accordance with one aspect of the present invention.

With reference now to FIG. 2, there is shown an illustrative reference circuit 200, in accordance with one aspect of the invention. The reference circuit 200 preferably includes an activity detector 202, a reference source 214 and an impedance control circuit 204. The reference source 214 is shown as a simple voltage divider comprising two resistors R1 and R2 connected in series between a positive voltage supply, which may be VDD, and a negative voltage supply, which may be VSS. The resistors R1, R2 may alternatively be implemented as active devices (e.g., transistors) which are appropriately biased in a linear region of operation, as understood by those skilled in the art. The present invention similarly contemplates that various other reference sources may be used by the reference circuit 200, such as, for example, a bandgap reference, etc.

A reference voltage VREF measured at a common junction between the resistors R1, R2 can be determined as:

$$VREF = (VDD - VSS) \times \frac{R2}{R1 + R2}$$

In addition, an output impedance $R_o$ associated with the reference source 214 may be determined as a parallel combination of the two resistors R1, R2:

$$R_o = \frac{R1 \cdot R2}{R1 + R2}$$

For low power consumption, the resistance value of resistors R1 and R2 are preferably made as high as possible. For example, if R1 and R2 are each 1000 ohms, the output impedance of the reference source will be 500 ohms. However, the reference source 214 will consume 0.9 milliamperes (mA) of DC current. If the resistors R1, R2 are increased in value to 10,000 ohms each, the DC current consumption of the reference source will be reduced to 0.09 mA, but the output impedance will increase to 5000 ohms. As previously explained, the increase in output impedance may permit noise or other signals (e.g., digital switching noise, analog crosstalk, etc.) to be undesirably coupled into the reference circuit 200.

The impedance control circuit 204 is shown operatively coupled to the output VREF of the reference source 214. The impedance control circuit 204 is preferably configured to dynamically change the output impedance of the reference circuit 200 in response to at least one control signal ZA. To accomplish this, an illustrative impedance control circuit 204 includes a pair of switches 206, 208, each switch being coupled to a corresponding positive or negative voltage supply via a series-connected resistor R3 and R4, respectively. One skilled in the art will appreciate that resistors R3, R4 may alternatively be implemented using active devices (e.g., transistors), biased in a linear region of operation, in a manner consistent with the implementation of resistors R1 and R2, as previously described.

In order to minimize an "on" resistance of a given switch 206, 208, each of the switches may include a pair of complementary transistors coupled together in parallel. For example, switch 206 may comprise an n-type MOS (NMOS) transistor M1 and a p-type MOS (PMOS) transistor M2, each of the transistors having a drain (D) terminal, a gate (G) terminal, and a source (S) terminal. The drain and source terminals of transistor M1 are connected to the source and drain terminals, respectively, of transistor M2, although, since MOS transistors are essentially bidirectional devices, the source and drain terminals of either or both transistors may be interchanged. Likewise, switch 208 comprises an NMOS transistor M3 and a PMOS transistor M4, each of the transistors having a drain (D) terminal, a gate (G) terminal, and a source (S) terminal. The drain and source terminals of transistor M3 are connected to the source and drain terminals, respectively, of transistor M4.

Each of the switches 206, 208 preferably includes a control input ZA for receiving a control signal presented thereto. The switches are responsive to the corresponding control signal for controlling a state (e.g., on or off) of the particular switch. Since the illustrative switches 206, 208 are implemented using complementary transistors, each of the switches 206, 208 may include a second control input ZAN for receiving a second control signal which is the complement of the control signal presented to control input ZA. It is to be appreciated that the second control signal may be generated internally with respect to a given switch, such as, for example, by an inverter (not shown) included therein, in which case one of the complementary control inputs ZA, ZAN may be eliminated.

Control input ZA is preferably coupled to the gate terminal of transistors M1 and M3. Likewise, control input ZAN is coupled to the gate terminal of transistors M2 and M4. When a control signal presented to control input ZA is a logic high level (e.g., VDD), the control signal presented to control input ZAN will be a logic low signal (e.g., VSS), thus activating both switches 206, 208 by turning on transistors M1 through M4. In this manner, the output VREF of the reference circuit 200 will be coupled to the positive and negative voltage supplies through resistors R3 and R4, respectively.

The values of resistors R3 and R4 are preferably selected to provide a desired output impedance $R_{PEF}$ looking into the output VREF of the reference circuit 200, as shown in the figure. If resistors R3 and R4 are selected to be substantially lower in value (e.g., a factor of ten or more) in relative comparison to resistors R1 and R2, the parallel combination of resistors R3 and R4 will predominantly determine the overall output impedance $R_{REF}$ of the reference circuit. The output impedance $R_{REF}$ of the reference circuit 200 when the impedance control circuit 204 is inactive (i.e., off) is substantially the same as the output impedance $R_o$ of the reference source 214 alone. When the impedance control circuit is active (i.e., on), the output impedance $R_{REF}$ is preferably substantially lower than the output impedance $R_o$ of the reference source 214 alone. As previously explained, the output impedance of the reference source 214 may be determined as the parallel combination of resistors R1 and R2. When switches 206 and 208 are active, the overall output impedance $R_{REF}$ of the reference circuit 200 may be determined as the parallel combination of resistors R1 through R4:

$$R_{REF} = \frac{1}{\frac{1}{R1} + \frac{1}{R2} + \frac{1}{R3} + \frac{1}{R4}}$$

By way of example only, assuming resistors R1 and R2 are each 10 kilo (K) ohms, the output impedance $R_o$ of the reference source 214 will be 5 K ohms. If the desired output impedance $R_{REF}$ of the reference circuit is about 500 ohms, a factor often lower, resistors R3 and R4 can be selected to be about 1 K ohms each. In order to keep the reference voltage VREF generated by the reference source 214 substantially unchanged when switches 206, 208 are active, a ratio between resistors R1 and R3 is preferably matched to a ratio between resistors R2 and R4.

As previously described, any one of resistors R1 through R4 may be alternatively implemented using active devices (e.g., transistors) that are biased at a predetermined quiescent operating point, preferably in a linear region of operation. For example, resistors R1 and R3 may be replaced by PMOS transistors (not shown), each of the transistors having a drain (D) terminal, a gate (G) terminal, and a source (S) terminal. The source terminals of the PMOS transistors may be connected to the positive voltage supply VDD, the drain terminal of the transistor replacing resistor R1 maybe connected to the output node VREF, the drain terminal of the transistor replacing resistor R3 may be connected to switch 206 at node 210, and the gate terminals of the PMOS transistors maybe connected to a predetermined bias source PBIAS for controlling a drain-to-source resistance $r_{DS}$ associated with the transistors. Similarly, resistors R2 and R4 may be replaced by, for example, NMOS transistors (not shown), each of the transistors having a drain (D) terminal, a gate (G) terminal, and a source (S) terminal. The source terminals of the NMOS transistors may be connected to the negative voltage supply VSS, the drain terminal of the transistor replacing resistor R2 may be connected to the output node VREF, the drain terminal of the transistor replacing resistor R4 maybe connected to switch 208 at node 212, and the gate terminals of the NMOS transistors may be connected to a predetermined bias source NBIAS.

The effective resistance $r_{DS}$ of a particular transistor may be approximated as:

$$r_{DS} = \frac{1}{K'\frac{W}{L}(V_{GS} - V_T - V_{DS})}$$

where, for the particular transistor, K' is a transconductance parameter, W is an effective channel width of the transistor, L is an effective channel length, $V_{GS}$ is a gate-to-source voltage, $V_T$ is a threshold voltage of the transistor, and $V_{DS}$ is a drain-to-source voltage of the transistor, as understood by those skilled in the art. It is apparent from the above equation that the respective resistance $r_{DS}$ of the transistors may be easily matched by simply scaling the width-to-length (W/L) ratios of the respective transistors, all other variables being substantially unchanged. For example, in order to scale the equivalent resistances of R1 and R3 by a ratio of 1:10 using PMOS transistors coupled to a common bias source, the W/L ratio of the transistor replacing resistor R3 is preferably configured to be ten times smaller than the W/L ratio of the transistor replacing resistor R1.

As previously stated, the illustrative reference circuit 200 includes an activity detector 202 which is coupled to the impedance control circuit 204. The activity detector 202 preferably includes an activity level input A and generates at least one of the control signals ZA and/or ZAN for dynamically controlling the overall impedance of the reference circuit in response to a measured activity level signal presented to the activity level input A. Preferably, activity level input A is of substantially high impedance, so that when the activity level input A is coupled to a circuit node for measuring the circuit activity at that node, there is negligible loading.

The activity detector 202 is preferably configured to generate an active (e.g., logic high) control signal ZA as long as a magnitude of the activity level signal changes during a predetermined time period $\tau$. When the activity level signal presented to input A remains unchanged after the time period $\tau$ has passed, the control signal ZA will become inactive (e.g., logic low), indicating that no activity has occurred during the period $\tau$. During a period of measured activity, the control signals ZA, ZAN generated by the activity detector 202 preferably enable the impedance control circuit 204, thereby reducing the output impedance of the reference circuit 200. Similarly, during a period of measured inactivity, the control signals ZA, ZAN will preferably disable the impedance control circuit 204. With the impedance control circuit 204 disabled, the output impedance $R_{REF}$ of the reference circuit 200 will be substantially the same as the output impedance $R_o$ of the reference source 214.

Figure 3:
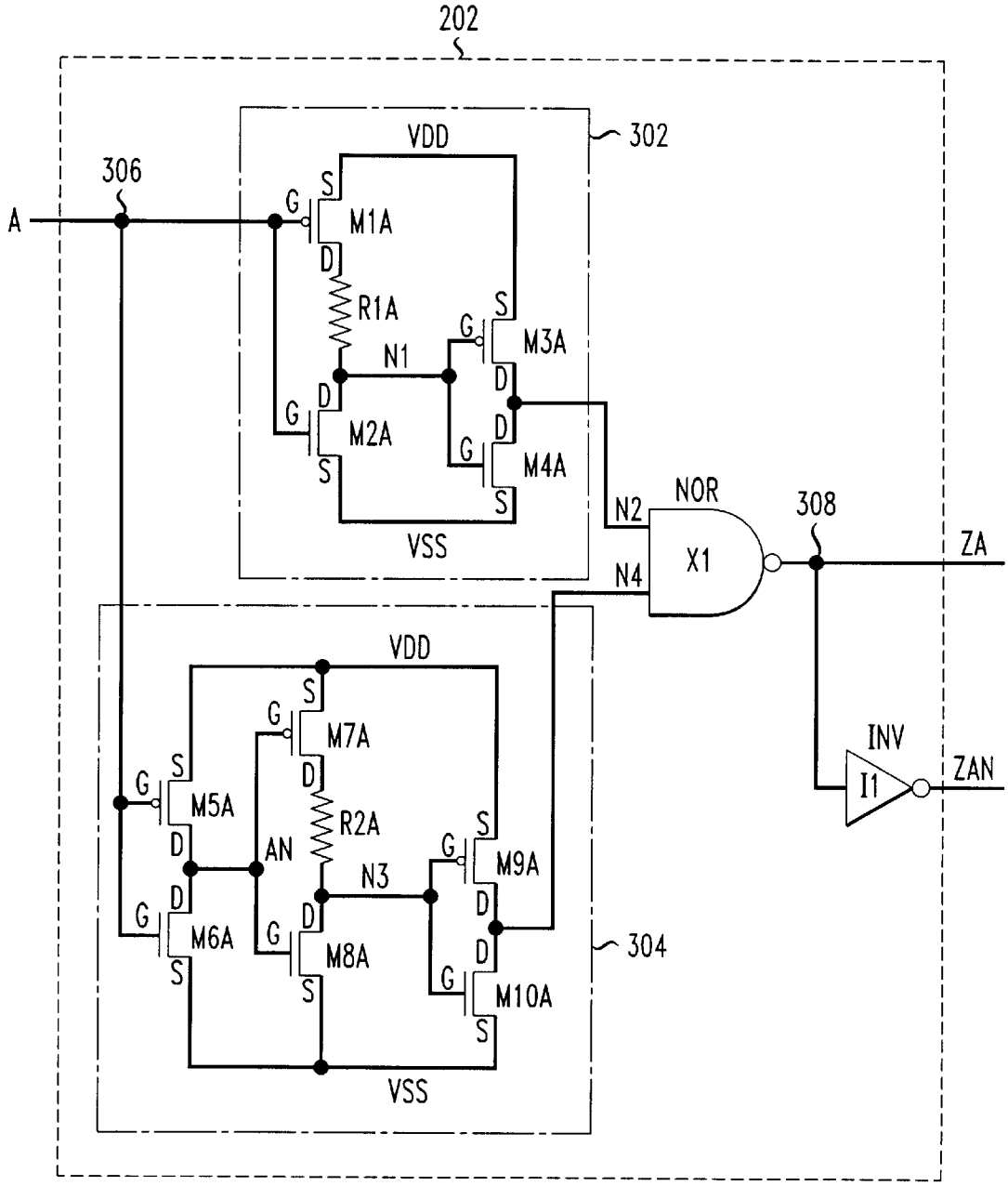
FIG. 3 is a schematic diagram illustrating a more detailed view of an exemplary activity detector of the FIG. 2 reference circuit, formed in accordance with one aspect of the present invention.

In FIG. 3 there is shown an illustrative activity detector 202, suitable for use with the present invention. It is to be appreciated, however, that the invention is not limited to this or any particular activity detector circuit. As apparent from the figure, the illustrative activity detector circuit 202 includes a NOR gate X1 having at least two inputs, at nodes N2 and N4, and an output at node 308 for generating the control signal ZA. A complementary control signal ZAN may be generated, for example, by passing the control signal ZA through an inverter I1.

The inputs N2, N4 of the NOR gate X1 preferably receive signals generated by two similar circuits 302 and 304, each of the circuits receiving the activity level signal A at an input 306 of the activity detector 202. Circuit 302 preferably includes a first inverter comprising a PMOS transistor M1A, an NMOS transistor M2A, and a resistor R1A connected in series between transistors M1A and M2A. A source (S) terminal of transistor M1A is preferably connected to the positive voltage supply VDD and a drain (D) terminal of transistor M1A is connected to one end of the resistor R1A. Likewise, a source (S) terminal of transistor M2A is preferably connected to the negative voltage supply VSS and a drain (D) terminal of transistor M2A is connected to the other end of resistor R1A to form an output of the first inverter at node N1. Resistor R1A is preferably used to selectively control a time constant $t_{C1}$ associated with node N1. Gate (G) terminals of transistors M1A and M2A are preferably coupled to the activity level input at node 306.

The output of the first inverter at node N1 may be passed through a second inverter comprising PMOS transistor M3A and NMOS transistor M4A operatively coupled together in a conventional manner. Specifically, gate (G) terminals of transistors M3A and M4A are connected to node N1 and drain (D) terminals of transistors M3A and M4A are connected together to form an output of the second inverter. Source (S) terminals of transistors M3A and M4A are connected to the positive (e.g., VDD) and negative (e.g., VSS) voltage supplies, respectively. The output of the second inverter is coupled to input N2 of NOR gate X1.

Circuit 304 may be formed in a manner consistent with circuit 302, except that circuit 304 preferably includes an additional inverter, comprising transistors M5A and M6A coupled together in a conventional manner, for generating an inverse or complementary activity level signal at node AN. Circuit 304, like circuit 302 previously described, preferably includes a first inverter comprising a PMOS transistor M7A, an NMOS transistor M8A, and a resistor R2A connected in series between transistors M7A and M8A. A source (S) terminal of transistor M7A is preferably connected to the positive voltage supply VDD and a drain (D) terminal of transistor M7A is connected to one end of the resistor R2A. Likewise, a source (S) terminal of transistor M8A is preferably connected to the negative voltage supply VSS and a drain (D) terminal of transistor M8A is connected to the other end of resistor R2A to form an output at node N3. Resistor R2A is preferably used to selectively control a time constant $t_{C2}$ associated with node N3. Gate (G) terminals of transistors M7A and M8A are preferably coupled to node AN for receiving the complementary activity level signal. The output of the first inverter at node N3 may be passed through a second inverter comprising PMOS transistor M9A and NMOS transistor M10A operatively coupled together in a conventional manner. An output of the second inverter associated with circuit 304 is preferably coupled to the input N4 of NOR gate X1.

As previously explained, resistors R1A and R2A function, at least in part, to selectively control a time constant $t_{C1}$, $t_{C2}$ by which nodes N1 and N3, respectively, are charged to a logic high level (e.g., VDD). The time constant $t_C$ for a given node N1, N3 may be determined by the expression $t_C$=RC, where R is the value of resistor R1A or R2A, respectively, and C is an equivalent capacitance of the corresponding node N1, N3. The equivalent capacitance C of a given node N1, N3 may include gate capacitances of corresponding transistors M3A and M4A, M9A and M10A, respectively, as well as a drain-to-source capacitance of corresponding transistor M2A, M8A, respectively. Preferably, the time constants $t_{C1}$, $t_{C2}$ of the first inverters associated with circuits 302, 304, respectively, are substantially matched to one another. It is to be appreciated, however, that the time constants $t_{C1}$, $t_{C2}$ may be individually selected, and therefore need not be the same.

Assuming the activity level signal presented to the activity level input A of the activity detector 202 is a digital signal, when the activity level signal is a logic low level (e.g., VSS), node N2 will also be a logic low level and node N4 will be a logic high level. Thus, the output ZA of the NOR gate X1 will be a logic low level. Likewise, when the activity level signal is a logic high level (e.g., VDD), node N2 will be a logic high level, node N4 will be a logic low level, and the output ZA of the NOR gate X1 will thus be a logic low level.

When the activity input signal is switching at a relatively rapid rate (e.g., faster than the time constant $t_C$ associated with a given circuit 302, 304), nodes N1 and N3 will remain at a logic low level, since the discharge times for nodes N1 and N3 are preferably significantly less compared to the charge times through resistors R1A and R2A, respectively. Since nodes N1 and N3 will remain at a logic low level in this instance, nodes N2 and N4 will remain at a logic high level, thus setting the output ZA of the NOR gate X1 to a logic high level, indicating activity on a particular node(s) associated with the activity level signal within a predetermined time period $t_p$. The time period $t_p$ for measuring the activity level of a given circuit node will be primarily established by the time constant $t_C$ of the first inverters associated with circuits 302, 304, and threshold voltages corresponding to the second inverters driving nodes N2 and N4.

Exemplary sizes for each of the transistors, as well as other components in the reference circuit of the present invention, are presented in Table 1 below for a conventional 0.16 micron ($\mu$m) complementary metal-oxide-semiconductor (CMOS) fabrication process. It is to be appreciated, however, that the present invention is not to be limited to these specific sizes or to the type of fabrication process employed, but that other sizes and alternative circuit fabrication processes may be utilized in accordance with the techniques of the present invention as set forth herein.

TABLE 1

| Component Reference Name | Size/Value |
|---|---|
| M1 | 10.0 $\mu$m/0.32 $\mu$m |
| M2 | 10.0 $\mu$m/0.28 $\mu$m |
| M3 | 10.0 $\mu$m/0.32 $\mu$m |
| M4 | 10.0 $\mu$m/0.28 $\mu$m |
| R1 | 10K ohms |
| R2 | 10K ohms |
| R3 | 1K ohms |
| R4 | 1K ohms |
| M1A | 10.0 $\mu$m/0.16 $\mu$m |
| M2A | 5.0 $\mu$m/0.16 $\mu$m |
| M3A | 10.0 $\mu$m/0.16 $\mu$m |
| M4A | 5.0 $\mu$m/0.16 $\mu$m |
| M5A | 10.0 $\mu$m/0.16 $\mu$m |
| M6A | 5.0 $\mu$m/0.16 $\mu$m |
| M7A | 10.0 $\mu$m/0.16 $\mu$m |
| M8A | 5.0 $\mu$m/0.16 $\mu$m |
| M9A | 10.0 $\mu$m/0.16 $\mu$m |
| M10A | 5.0 $\mu$m/0.16 $\mu$m |
| R1A | 100K ohms |
| R2A | 100K ohms |

The present invention thus described provides a reference circuit that is capable of dynamically changing an output impedance associated therewith, such that when activity is detected on a given node, for example, in another circuit coupled to the reference circuit, the output impedance of the reference circuit is at a first value which is sufficiently low so as to reduce the likelihood of noise being undesirably coupled onto the output of the reference circuit. Alternatively, when essentially no activity is detected on the node within a predetermined time period, the output impedance of the reference circuit is at a second value which is sufficiently greater than the first value so as to reduce power consumption in the reference circuit.

Although illustrative embodiments of the present invention have been described herein with reference to the accompanying drawings, it is to be understood that the invention is not limited to those precise embodiments, and that various other changes and modifications maybe made therein by one skilled in the art without departing from the scope of the appended claims.

What is claimed is:

1. A reference circuit comprising:

a reference source including an output for generating at least one of a reference voltage and a reference current;

an activity detector configured to measure an activity level of at least a portion of another circuit coupled to the reference circuit and to generate at least one control signal representative of the activity level; and a controller configured to dynamically change an output impedance of the reference circuit in response to the at least one control signal, whereby the output impedance of the reference circuit is reduced when activity is detected in the other circuit;

wherein at least one of the reference voltage and the reference current is substantially unchanged between a period during which no activity is detected in the other circuit and a period during which activity is detected in the other circuit;

wherein the controller comprises at least one switch operatively coupled to the output of the reference source, the at least one switch including at least one control input for receiving the at least one control signal, the at least one switch being configured to provide a substantially low resistance electrical connection between the output of the reference source and one of a positive voltage supply and a negative voltage supply;

wherein the controller further includes at least one resistor operatively coupled to the at least one switch and in series between the output of the reference source and one of the positive voltage supply and the negative voltage supply, a resistance value of the at least one resistor being selected to provide a predetermined output impedance of the reference circuit when activity is detected in the other circuit.

2. The reference circuit of claim 1, wherein the controller is configured to increase the output impedance of the reference circuit when no activity is detected in the other circuit during a time period.

3. The reference circuit of claim 1, wherein the controller further includes at least one transistor operatively coupled to the at least one switch and in series between the output of the reference source and one of the positive voltage supply and the negative voltage supply, the at least one transistor being biased at a quiescent operating point so that an equivalent resistance associated with the at least one transistor is selected to provide a predetermined output impedance of the reference circuit when activity is detected in the other circuit.

4. The reference circuit of claim 1, wherein the at least one switch comprises at least one transistor for selectively coupling the output of the reference source to one of the positive voltage supply and the negative voltage supply in response to the at least one control signal.

5. The reference circuit of claim 1, wherein the activity detector comprises:

an input for receiving an activity level signal from the other circuit to be measured and at least one output for generating the at least one control signal;

a first circuit configured to receive the activity level signal and to generate a first output signal, the first circuit having a first selectable time constant associated therewith;

a second circuit configured to receive a complement of the activity level signal and to generate a second output signal, the second circuit having a second selectable time constant associated therewith; and a summing node for receiving the first and second output signals and generating the at least one control signal, the at least one control signal being functionally related to the first and second output signals.

6. The reference circuit of claim 5, wherein a time period during which the activity level of the other circuit to be measured is determined, at least in part, by operatively adjusting at least one of the first and second selectable time constants associated with the first and second circuits.

7. The reference circuit of claim 1, wherein:

the output impedance of the reference circuit is set to a first value when activity is detected in the other circuit, the first value being sufficiently low so as to reduce a likelihood of noise being coupled onto an output of the reference circuit; and the output impedance of the reference circuit is set to a second value when no activity is detected in the other circuit, the second value being greater than the first value.

8. The reference circuit of claim 1, wherein the first value is at least a factor of ten less than the second value.

9. A reference circuit comprising:

a reference source including an output for generating at least one of a reference voltage and a reference current;

an activity detector configured to measure an activity level of at least a portion of another circuit coupled to the reference circuit and to generate at least one control signal representative of the activity level; and a controller configured to dynamically change an output impedance of the reference circuit in response to the at least one control signal, whereby the output impedance of the reference circuit is reduced when activity is detected in the other circuit;

wherein at least one of the reference voltage and the reference current is substantially unchanged between a period during which no activity is detected in the other circuit and a period during which activity is detected in the other circuit;

wherein the controller comprises:

a first resistor having a first resistance value associated therewith and being coupled at one end to a positive voltage supply;

a second resistor having a second resistance value associated therewith and being coupled at one end to a negative voltage supply;

a first switch operatively coupled between the first resistor and the output of the reference source, the first switch electrically connecting the output of the reference source to the positive voltage supply in response to the at least one control signal; and a second switch operatively coupled between the second resistor and the output of the reference source, the second switch electrically connecting the output of the reference source to the negative voltage supply in response to the at least one control signal.

10. The reference circuit of claim 9, wherein the output impedance of the reference circuit when activity is detected is determined, at least in part, by a parallel combination of the first and second resistors.

11. A reference circuit comprising:

a reference source including an output for generating at least one of a reference voltage and a reference current;

an activity detector configured to measure an activity level of at least a portion of another circuit coupled to the reference circuit and to generate at least one control signal representative of the activity level; and a controller configured to dynamically change an output impedance of the reference circuit in response to the at least one control signal, whereby the output impedance of the reference circuit is reduced when activity is detected in the other circuit;

wherein the activity detector comprises:

an input for receiving an activity level signal from the other circuit to be measured and at least one output for generating the at least one control signal;

a first circuit configured to receive the activity level signal and to generate a first output signal, the first circuit having a first selectable time constant associated therewith;

a second circuit configured to receive a complement of the activity level signal and to generate a second output signal, the second circuit having a second selectable time constant associated therewith; and a summing node for receiving the first and second output signals and generating the at least one control signal, the at least one control signal being functionally related to the first and second output signals; and wherein:

the first circuit comprises:

a first inverter having an input for receiving the activity level signal and an output, the first inverter including means for selectively changing a time constant associated therewith; and a second inverter having an input operatively coupled to the output of the first inverter and an output for generating the first output signal; and the second circuit comprises:

a third inverter having an input for receiving the activity level signal and an output for generating an inverse activity level signal;

a fourth inverter having an input for receiving the inverse activity level signal and an output, the fourth inverter including means for selectively changing a time constant associated therewith; and a fifth inverter having an input operatively coupled to the output of the fourth inverter and an output for generating the second output signal.

12. An integrated circuit including one or more reference circuits, at least one of the reference circuits comprising:

a reference source including an output for generating at least one of a reference voltage and a reference current;

an activity detector configured to measure an activity level of at least a portion of another circuit coupled to the reference circuit and to generate at least one control signal representative of the activity level; and a controller configured to dynamically change an output impedance of the reference circuit in response to the at least one control signal, whereby the output impedance of the reference circuit is reduced when activity is detected in the other circuit;

wherein at least one of the reference voltage and the reference is substantially unchanged between a period during which no activity is detected in the other circuit and a period during which activity is detected in the other circuit;

wherein the controller comprises at least one switch operatively coupled to the output of the reference source, the at least one switch including at least one control input for receiving the at least one control signal, the at least one switch being configured to provide a substantially low resistance electrical connection between the output of the reference source and one of a positive voltage supply and a negative voltage supply;

wherein the controller further includes at least one resistor operatively coupled to the at least one switch and in series between the output of the reference source and one of the positive voltage supply and the negative voltage supplys a resistance value of the at least one resistor being selected to provide a predetermined output impedance of the reference circuit when activity is detected in the other circuit.

* * * * *